US007782221B2

(12) United States Patent
Arguello et al.

(10) Patent No.: US 7,782,221 B2
(45) Date of Patent: Aug. 24, 2010

(54) EMERGENCY SHUTDOWN DETECTION DEVICE FOR A GAS TURBINE

(75) Inventors: Gustavo Arguello, Berlin (DE); Clemens Chaskel, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 519 days.

(21) Appl. No.: 11/730,943

(22) Filed: Apr. 5, 2007

(65) Prior Publication Data

US 2007/0241921 A1 Oct. 18, 2007

(30) Foreign Application Priority Data

Apr. 5, 2006 (DE) ..... 10 2006 016 011

(51) Int. Cl.
*G08B 21/00* (2006.01)

(52) U.S. Cl. ..... 340/687; 340/679; 340/686.1; 340/686.2; 340/686.3; 340/657; 415/118

(58) Field of Classification Search ..... 340/679–687, 340/686.3, 652, 657; 415/1, 118
See application file for complete search history.

(56) References Cited

U.S. PATENT DOCUMENTS 4,684,293 A * 8/1987 Takafuji ..... 405/224
4,868,508 A * 9/1989 Ohishi ..... 324/525
5,001,465 A * 3/1991 Siegel ..... 340/685
5,637,794 A * 6/1997 Hanisko ..... 73/121
5,841,617 A * 11/1998 Watkins et al. ..... 361/106
6,360,850 B1 * 3/2002 Odisho et al. ..... 188/1.11 L
6,445,099 B1 * 9/2002 Roseman ..... 310/90
6,607,349 B2 * 8/2003 Mulera et al. ..... 415/1
7,079,031 B2 * 7/2006 Ott ..... 340/568.2
7,119,684 B2 * 10/2006 Petersen et al. ..... 340/568.1
7,289,302 B1 * 10/2007 Mallary ..... 360/323
2004/0153539 A1 * 8/2004 Lyon et al. ..... 709/224

FOREIGN PATENT DOCUMENTS

DE 19 15 930 A 2/1970
DE 20 62 047 A 7/1972
DE 10 2004 036 725 8/2005
GB 1 239 349 7/1971
GB 1 374 988 11/1974

* cited by examiner

*Primary Examiner*—Daniel Wu
*Assistant Examiner*—Son M Tang
(74) *Attorney, Agent, or Firm*—Timothy J. Klima; Shuttleworth & Ingersoll, PLC

(57) ABSTRACT

An emergency shutdown detection device for a gas turbine includes a longish, mechanically severable sensor element (5), in which at least one electric line (1 to 4) is provided, with at least one resistor (R1 to R3) being electrically connected to the electric line such that upon severance of the sensor element (5), the electrically connected resistor is electrically disconnected from the electrical line to alter a resistance value for the electrical line.

4 Claims, 2 Drawing Sheets

EMERGENCY SHUTDOWN DETECTION DEVICE FOR A GAS TURBINE

Figure 2:
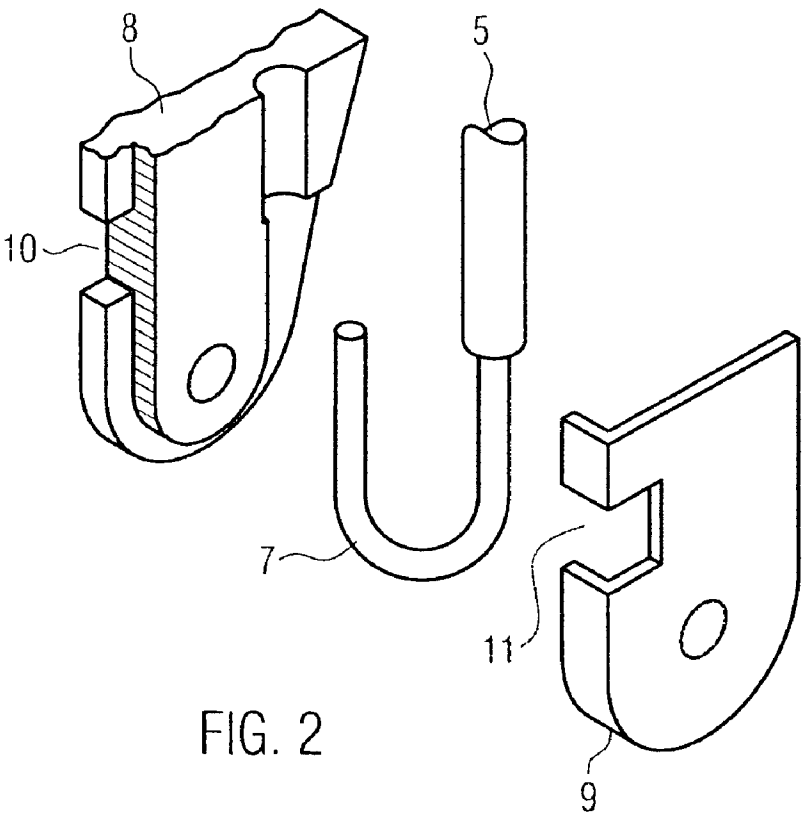

This application claims priority to German Patent Application DE102006016011.8 filed Apr. 5, 2006, the entirety of which is incorporated by reference herein.

This invention relates to an emergency shutdown detection device for a gas turbine, more particularly to an emergency shutdown detection device which responds to a shaft failure of a gas turbine to interrupt the fuel supply or to act suitably on the turbine control system in such an emergency case.

Most different design variants are known from the state of the art which operate partly mechanically and partly electromechanically. Please refer to U.S. Pat. Nos. 6,607,349B2, 5,293,774, 4,737,709 and 3,612,710 or DE 197 27 296 A1 in particular. These known emergency shutdown detection devices are problematic in that they may misinterpret a break of a cable connection or contact problems of the device itself as an incident although an actual shaft failure has not occurred and the sensor element proper was not severed.

To compound matters, considerable temperature differences may occur in gas turbine operation which may also result in malfunction of the known devices.

In a broad aspect, the present invention provides an emergency shutdown detection device for a gas turbine, which while being characterized by simple design and simple and cost-effective producibility, features a maximum degree of operational reliability.

It is a particular object of the present invention to provide at least one solution to the above problems by a combination of the features cited herein. Further advantageous embodiments of the present invention will become apparent from the description below.

The emergency shutdown detection device in accordance with the present invention is based on the fundamental idea of providing a circuitry by means of at least one resistor which not just features an infinitely large or infinitely small electric resistance (depending on whether an electric line is interrupted or in contact) but has a defined electric resistance allowing a definite statement to be made on whether either an actual shaft failure with mechanical severance of the sensor element or some other electrical defect of the emergency shutdown detection device, the sensor element or the appertaining control system has occurred.

In the case of a shaft failure, the shaft is axially displaced over a certain distance, for example 5 mm. The mechanically severable sensor element is cut through by suitable teeth or shearing knives as they collide with the sensor element upon a shaft failure. Accordingly, in the design according to the present invention, more particularly when using the three resistors and the appertaining circuitry described in the subclaims, one resistor is severed from the overall circuitry in a defined way. Thus, only the two other resistors will remain effective. Consequently, the total resistance is changed in a defined manner. This change in resistance is pre-definable and checkable in the control system. However, if a short circuit occurs in the electric line or in the area of the supply lines etc., the electric resistance will change to zero. Such a change is readily interpretable by the control system as non-indicative of a shaft failure, i.e., a severance of the free end portion of the sensor element. Should the supply lines be interrupted, for example by contact problems or other defects, the resultant resistance would become infinite. Such a resistance would not be indicative of a shaft failure either.

Therefore, the design according to the present invention provides for a defined resistance in the total circuitry which can only occur in the event of a shaft failure and, accordingly, when the free end of the sensor element is severed or sheared off. Other defects, for example a short circuit in the area of the sensor element, will result in different resistance values which specifically correspond to the resistors used and are thus detectable by the control system.

The design according to the present invention is further advantageous in that it provides for a defined operating mode under temperature changes in the area of the resistors which may occur, for example, in the range of minus 55 to plus 260 degrees centigrade. Since the specific resistance values of the individual resistors change proportionally to each other under such temperature changes, the specific proportionality described at the beginning or the relation between the resistance values upon an actual shaft failure or upon some other malfunction remains uncompromised. In particular, if resistors with standardized temperature coefficients are used, the device according to the present invention provides for a maximum degree of operational reliability.

The invention is more fully described in light of the accompanying drawings showing one or more preferred embodiment(s). In the Figures, FIG. 1 is a schematic representation of the overall arrangement of the emergency shutdown detection device with sensor element in accordance with the present invention, FIG. 2 is an enlarged exploded view of a holder of the free end area of the sensor element, FIG. 3 is a simplified representation of the circuitry in accordance with the present invention, and FIG. 4 shows another embodiment of the arrangement in accordance with the present invention.

Figure 1:
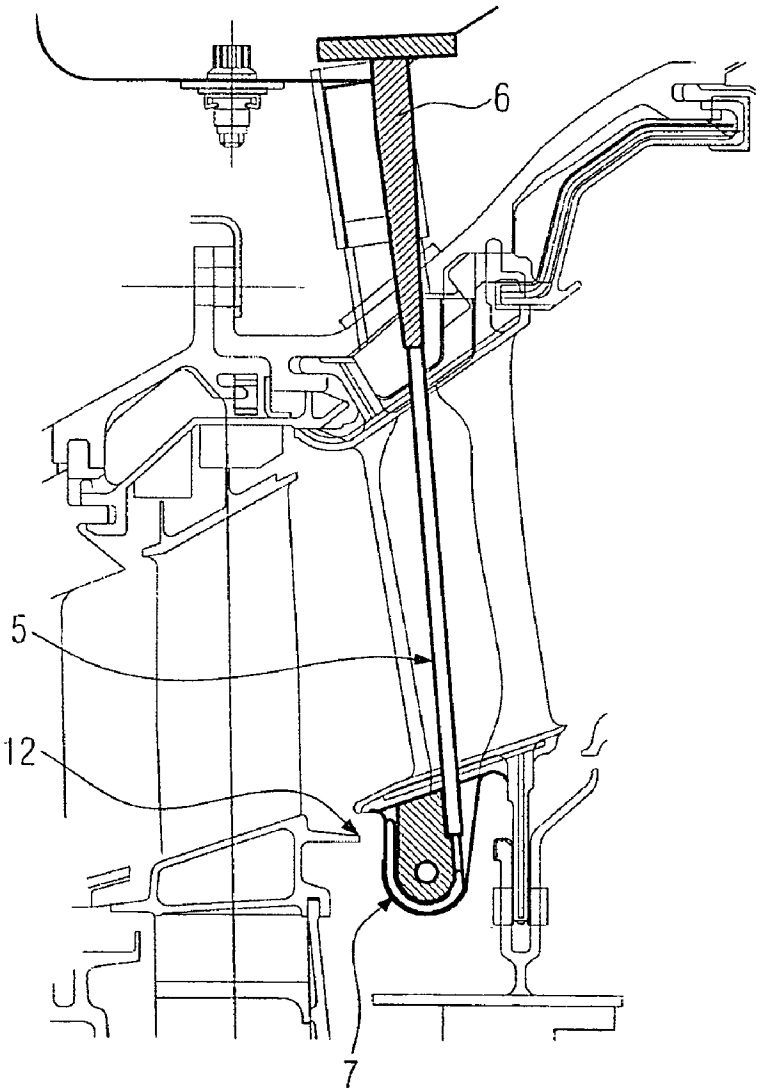

FIG. 1 shows a partial area of a gas turbine in schematic sectional view. Here, a sensor element 5 is shown which is of an elongated type and features a connecting portion 6 which is attachable in the usual manner.

When viewing FIGS. 1 and 2 as a whole, the free end 7 of the sensor element 5 is U-shaped and accommodated in a holder 8 and retained by a cover 9. The holder 8 comprises a groove 10 which, in the assembled state, coincides with a groove 11 of the cover 9, as illustrated in FIG. 1. In the area of the turbine, a separating tang 12 is provided which, upon a shaft failure, is axially displaced and, while engaging the grooves 10, 11, collides with the free end 7 of the sensor element 5, thus severing or shearing off the tip area of the latter. Shearing occurs in the area of a parting line 13 schematically shown in FIGS. 3 and 4.

Figure 3:
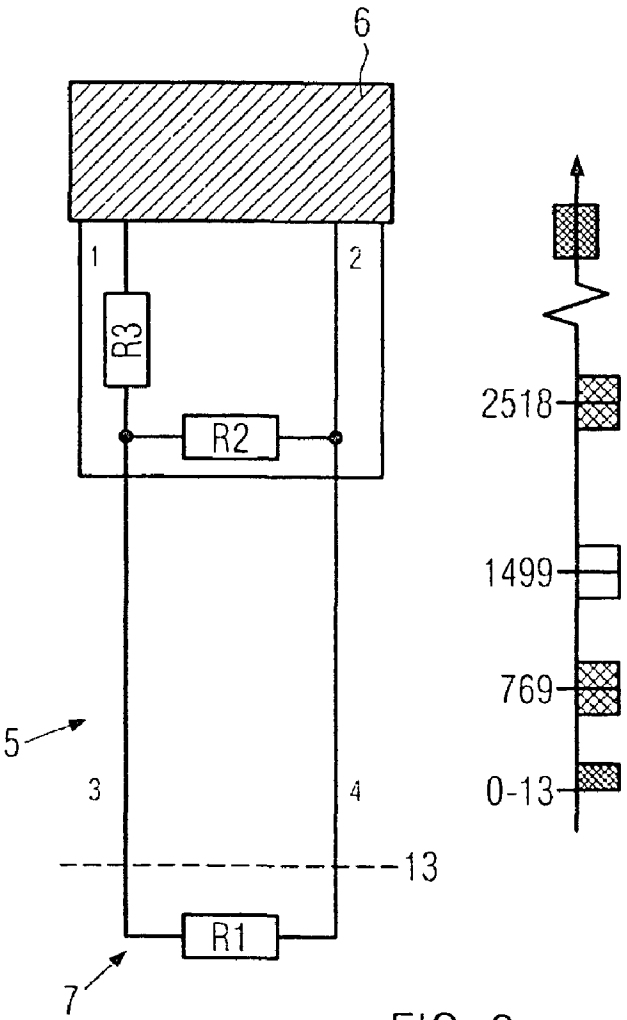
Figure 4:
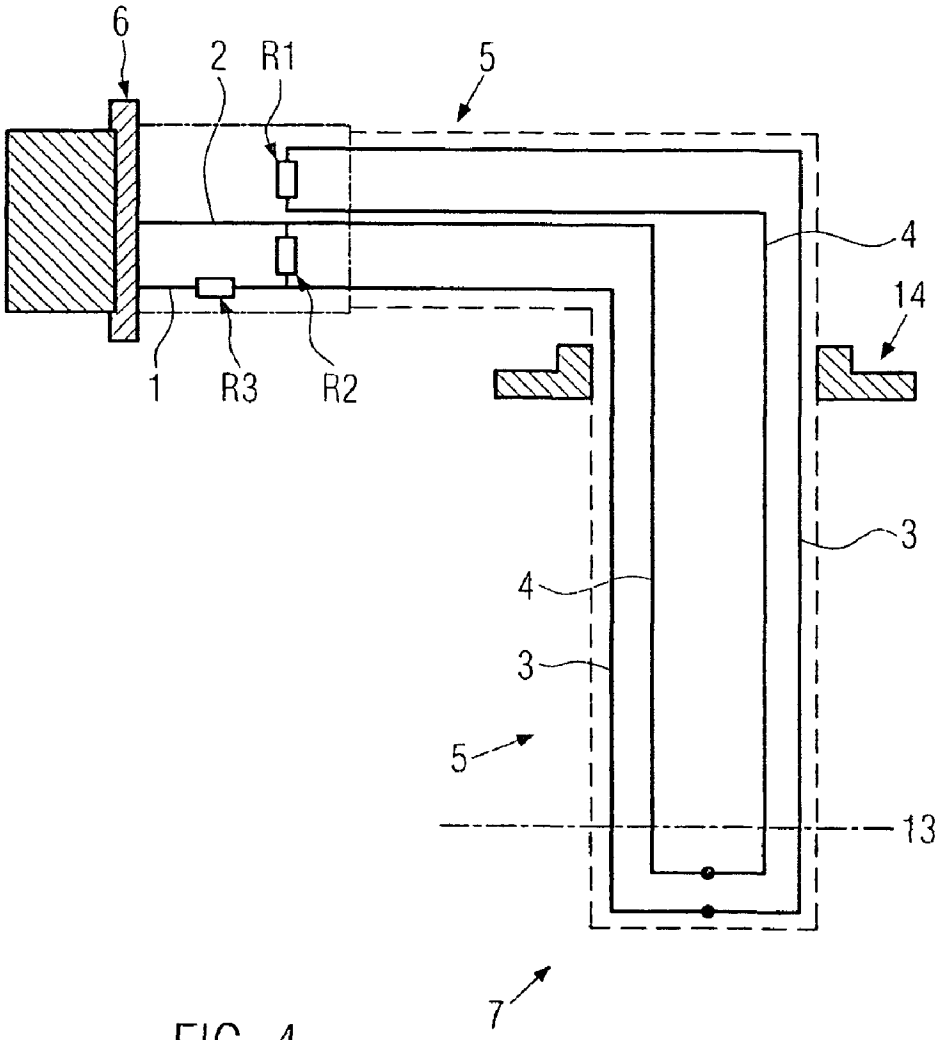

FIG. 3 shows, in schematic view, the electric circuitry of the emergency shutdown detection device according to the present invention. It comprises a connecting portion 6 as already mentioned above which is connected to a control system via electric connecting elements not shown. Attached to the connecting portion 6 is the sensor element 5 whose free end 7 is severable along the parting line 13.

In the interior of the sensor element 5, an electric supply line 1, 3 and an electric discharge line 2, 4 are provided each. In the area of the free end 7, the two lines 3, 4 are electrically connected via a resistor R1. In the upper area of the sensor element 5, adjacent to the connecting portion 6, the supply lines 1, 3 are connected to the discharge lines 2, 4 via a second electric resistor R2. Resistors R1 and R2 are arranged in parallel. Furthermore, a resistor R3 is arranged in series in the supply line 1. The embodiment in FIG. 4 differs from the embodiment in FIG. 3 in that the resistor R1 is now arranged adjacent to the connecting portion 6, so that both the supply line 3 and the discharge line 4 are looped through the free end 7 of the sensor element 5. This arrangement is selected such that all three resistors encounter the same thermal environment. This results in a further increase in operational safety.

Reference numeral 14 indicates a flange which may be provided for the attachment of the emergency shutdown detection device or the connecting portion 6, respectively.

In the embodiments shown, the resistance values amount to:

R1: 1250Ω,

R2: 1750Ω,

R3: 750Ω.

These resistance values were selected under the assumption that the resistance measuring range of the measuring instrument is limited to 3000 Ωmax. at an accuracy of +/−150Ω).

The resistors described in the above result in almost equidistant resistance values within the said measuring range, thus enabling the various defect states to be better distinguished.

Resistances for the embodiment of FIG. 3 are shown in the right-hand half of FIG. 3. The total resistance of the emergency shutdown detection device in normal operation is 1499Ω. An interruption of one of the lines 3 or 4, respectively, in the sensor element 5 or in its free end 7, respectively, results in a resistance of 2518Ω. A short circuit between the lines 3, 4 results in a resistance of 769Ω. A short circuit between the lines 1 and 2 results in a very low resistance (<13Ω). A break of one of the lines 1 or 2 results in an infinite resistance. In case of open circuit at R2 the resistant become 2060Ω.

Note: The measured total resistance stated above include the internal wire resistances.

The temperature changes encountered in the area of the resistors during the operation of the gas turbine will, in the present embodiment, result in variations of the respective resistance values of 8 percent, for example. Obviously, the above-specified values are exemplary only. However, in accordance with the present invention, clearly defined resistance values exist in the circuitry for individual operating states or malfunctions, enabling a shaft failure condition, and thus the severance of the free end 7 of the sensor element 5, to be readily distinguished from other operating malfunctions (short circuits, breaks or similar).

| List of reference numerals | |
|---|---|
| 1 | Supply line |
| 2 | Discharge line |

-continued

| List of reference numerals | |
|---|---|
| 3 | Supply line |
| 4 | Discharge line |
| 5 | Sensor element |
| 6 | Connecting portion |
| 7 | Free end |
| 8 | Holder |
| 9 | Cover |
| 10 | Groove |
| 11 | Groove |
| 12 | Separating tang |
| 13 | Parting line |
| 14 | Flange |

What is claimed is:

1. An emergency shutdown detection device for a gas turbine, comprising:

an elongated, mechanically severable sensor element, which includes at least one electrical line, the at least one electrical line including at least one electrically connected resistor such that upon severance of the sensor element, the electrically connected resistor is electrically disconnected from the electrical line to alter a resistance value for the electrical line;

at least one electric supply line and one electric discharge line which are electrically connected to each other in an area of a free end of the sensor element;

wherein the supply line includes a resistor R3 arranged in series and subsequently two resistors R2 and R1 arranged in parallel with the discharge line, with the supply line and the discharge line being electrically connected only by these two resistors R2 and R1 wherein the gas turbine is shutdown in response to the altered of said resistance value.

2. A device in accordance with claim 1, wherein parallel resistor R1 is arranged in a free end area of the sensor element and the two other resistors R2 and R3 are arranged in a connecting portion of the device.

3. A device in accordance with claim 1, wherein all of the resistors are arranged in the connecting portion of the device.

4. A device in accordance with claim 1, wherein all of the resistors are integrated into at least one of the connecting portion and a control device.

* * * * *